US008065966B1

(12) United States Patent
Bacon et al.

(10) Patent No.: US 8,065,966 B1
(45) Date of Patent: Nov. 29, 2011

(54) ODD LINK WORK SURFACE LIFT

(75) Inventors: Bruce C Bacon, Rockford, MI (US); Milton G Fenton, Wyoming, MI (US); Mitchell R Bakker, Holland, MI (US)

(73) Assignee: Bauer Products, Inc., Grand Rapids, MI (US)

( * ) Notice: Subject to any disclaimer, the term of this patent is extended or adjusted under 35 U.S.C. 154(b) by 313 days.

(21) Appl. No.: 12/566,353

(22) Filed: Sep. 24, 2009

(51) Int. Cl.
*A47B 9/00* (2006.01)

(52) U.S. Cl. ..... 108/145; 108/147

(58) Field of Classification Search ..... 108/147, 108/145, 144.11, 6, 7, 9
See application file for complete search history.

(56) References Cited

U.S. PATENT DOCUMENTS

| | | | | |
|---|---|---|---|---|
| 1,654,088 | A * | 12/1927 | Mullin | 211/47 |
| 3,472,183 | A * | 10/1969 | Goodman | 108/147 |
| 4,194,452 | A * | 3/1980 | Crowther et al. | 108/138 |
| 4,249,749 | A * | 2/1981 | Collier | 280/35 |
| 5,503,368 | A * | 4/1996 | Torres | 254/88 |
| 5,778,799 | A * | 7/1998 | Eyre | 108/7 |
| 6,038,986 | A * | 3/2000 | Ransil et al. | 108/145 |
| 6,691,199 | B1 * | 2/2004 | Yang | 710/305 |
| 6,691,626 | B2 * | 2/2004 | Warner | 108/145 |
| 7,111,825 | B2 * | 9/2006 | Landsberger et al. | 254/126 |
| 7,712,585 | B2 * | 5/2010 | Hoth | 187/269 |
| 8,015,638 | B2 * | 9/2011 | Shimada et al. | 5/611 |
| 2007/0163475 | A1 * | 7/2007 | Murphy | 108/147 |
| 2007/0266912 | A1 * | 11/2007 | Swain | 108/145 |

* cited by examiner

*Primary Examiner* — Janet M Wilkens
*Assistant Examiner* — Daniel Rohrhoff
(74) *Attorney, Agent, or Firm* — James Bartek

(57) ABSTRACT

An odd link work surface lift has a foundation with spaced front and back pivots, has a first link pivotally connected with the front pivot and extending to a first end, has a second link pivotally connected with the first end and extending to a second end, has a mounting bracket pivotally connected with the second end and extending to a terminal end, and a traveler link pivotally connected with the back pivot and extending to a cam follower. The mounting bracket has a curvilinear cam surface at the terminal end. The cam follower travels along the cam surface in abutting engagement. A length from the second end to the terminal end is materially greater than a length between the spaced front and back pivots.

35 Claims, 16 Drawing Sheets

FIG. 8
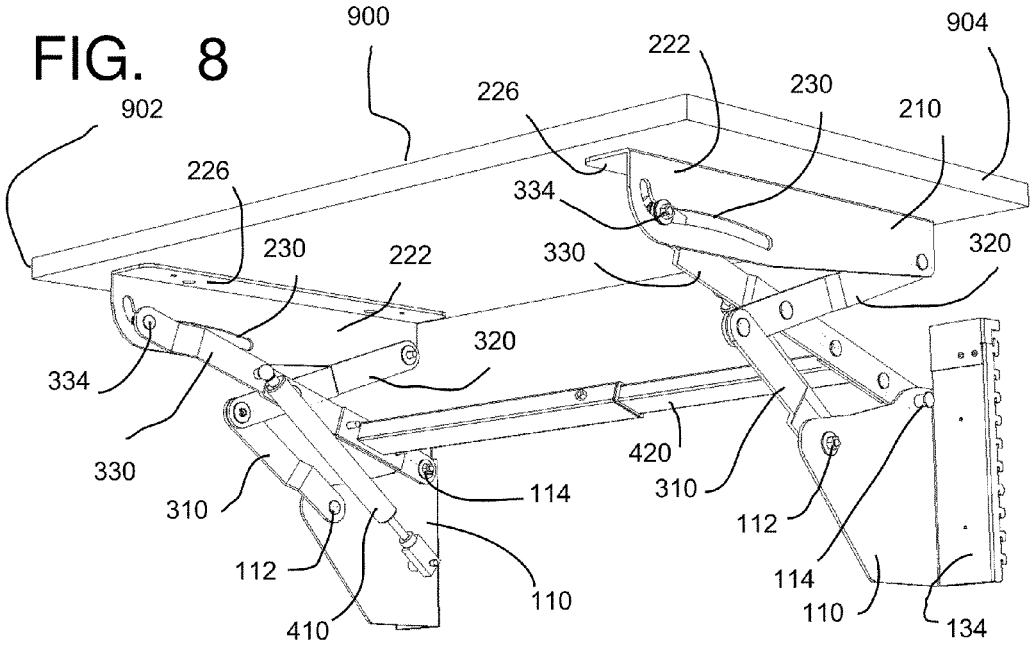
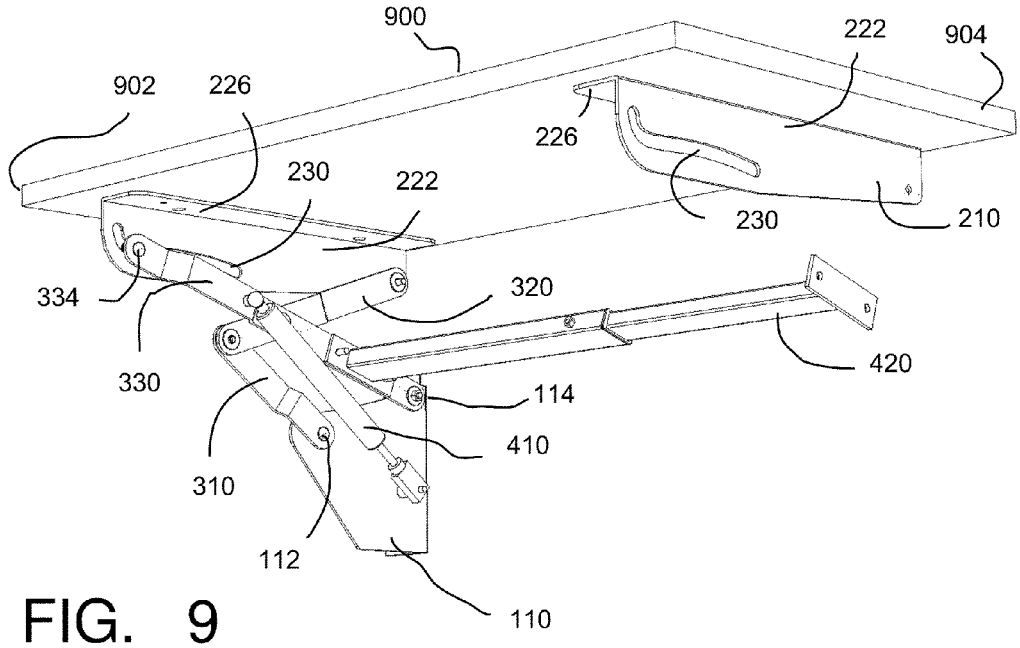
FIG. 9

ODD LINK WORK SURFACE LIFT

CROSS-REFERENCE TO RELATED APPLICATIONS

Not Applicable.

BACKGROUND OF THE INVENTION

The present invention relates to scissor jack work surface lifts and more specifically to an adjustable height desk, workbench, and the like.

Work surface scissor jack lifts are generally well known and understood with an even number of links or stacked pairs of scissor links as are shown in drawing FIGS. 1 and 2. These known scissor jack lift configurations have a link 50 pivotally connected 52 with a foundation 70 and supporting a table 72 in sliding engagement 54. Further, another link 60 is pivotally connected 62 with the table 72 and is supported by the foundation 70 in sliding engagement 64. The two links may commonly be pivotally interconnected with an interconnecting pivot 86 that is located at a common midpoint of the respective links.

A stance 80 may be defined by the pivot 52 and the extent of the stroke of the sliding engagement 64. A bearing length 82 is likewise defined by the pivot 62 and the extent of the stroke of the sliding engagement 54. The length of the stance 80 and the bearing length 82 are commonly substantially the same as a matter of geometry.

Alternatively, the interconnecting pivot 86 between the links 50 and 60 may be offset (not shown). As shown the pivot is centered. When the pivot is offset toward the foundation 70, the bearing length 82 becomes greater than the stance 80. Conversely, when the pivot is offset toward the table 72, the stance becomes greater than the bearing length.

None of these geometries is desirable in a height adjustable desk, workbench, or table work surface 72 and the like. In the situation of a centered pivot 86, the foundation 70 extends flush with the table such that an underlying floor is not clear. Rather, the floor is obstructed by the foundation such that the foundation may trip or otherwise interfere with a user.

When the pivot 86 is offset toward the foundation 70, the table 72 may be located in a lowered position adjacent a wall and the like, yet will move away from the wall when elevated. Thus, the surface encroaches on user space. Also, the range of elevation is diminished as compared with the centered pivot situation. Further, the stance 80 is less than the bearing length 82 such that an unacceptably reduced table stability may result.

Conversely, offsetting the pivot 86 toward the table 72 precludes preferred placement of the table adjacent a wall or other object because the stance 80 exceeds the bearing length 82. Thus, the foundation 70 also extends beyond, not merely flush with, the table and exacerbates the floor obstruction noted above.

Further, known work surface scissor jack lifts typically presume mounting or support from a horizontal surface, including a floor or the like. This inherently limits utility of such lifts in combination with vertical surfaces, including cabinets, walls, and panels and the like.

Thus, a need for an odd link work surface lift of the present invention is readily understood.

BRIEF SUMMARY OF THE INVENTION

Accordingly, an odd link work surface lift of the present invention is adapted to extend from a closed position to an open position and thereby elevate a connected work surface. The lift is also adapted to retract from the open position to the closed position and thereby lower a connected work surface. Uniquely, the invention utilizes an odd rather than an even array of links, including an elongated first link member with opposing first and second ends, an elongated second link member with opposing first and second ends, and an elongated traveler link member with opposing first and second ends. A foundation is also provided. A front pivot is provided near a foundation front, while a back pivot is provided near a foundation back. The first link first end is pivotally connected with the front pivot. The second link first end is pivotally connected with the first link second end. A mounting bracket is also provided as an elongated member with opposing first and second ends and a cam surface that extends from the bracket first end toward the opposite bracket second end. The second link second end is pivotally connected with the mounting bracket first end. The traveler link is pivotally connected at its first end with the back pivot and extends from the foundation to the cam surface. Thus, the traveler link is provided with a cam follower at its second end. The cam follower being positioned in abutting engagement with the cam slot and traveling along the cam surface in abutting engagement.

In further aspects of the invention, a stance is defined as a distance between the front and the back pivots. The mounting bracket may further have a bearing length that is defined as a distance between the pivot connection of its first end with the second link second end the mounting bracket second end. The bearing length is preferably significantly greater than the stance.

In other aspects of the invention, the second link may further have a link pivot between its first and second ends and the link pivot may be connected with the traveler link between its first and second ends. The cam surface may preferably be curvilinear and may further be configured with a stylized L-shape. This L-shaped may include an arcuate stem that extends generally horizontally from the mounting bracket front end toward the mounting bracket back end and include an arcuate that extends generally vertically upward at the mounting bracket front end from the stem. The leg may also include a cam stop.

In yet further aspects of the invention, the foundation may be fabricated with one of two portions of a coupling that is adapted to couple in releasable engagement with a cooperating second of the two portions of the coupling. The cooperating second portion may be provided as one of a partition panel adjustable hanging track, a wall mountable adjustable hanging track, a wall mountable fixed mounting bracket, and a floor standing leg that is adapted to support the foundation bracket and the lift above a supporting floor surface.

A counterbalance may also be provided as an extensible member that assists in opening the lift from the closed position in which the mounting bracket is relatively near the foundation and the counterbalance is in a retracted position, to the open position in which the mounting bracket is relatively apart from the foundation and the counterbalance is in an extended position. The counterbalance may extend between the foundation and one of the traveler link and the second link.

In other aspects of the invention, the lift may be considered as a first lift assembly and the invention may further have a work surface with opposite ends. A second lift assembly may be fastened with the work surface near a first one of the opposite ends, while the first lift assembly may be fastened with the work surface near a second one of the opposite ends. A synchronizer may interconnect the first and the second lift assemblies such that the first and the second lifts extend uniformly from their respective closed positions and retract uniformly from their respective open position.

These and other features, objects, and benefits of the invention will be recognized by one having ordinary skill in the art and by those who practice the invention, from this disclosure, including the specification, the claims, and the drawing figures.

BRIEF DESCRIPTION OF THE SEVERAL VIEWS OF THE DRAWING

FIG. 8 is the view of FIG. 3 with pinch guards and legs removed;

FIG. 9 is the view of FIG. 8 with right side odd links and right side foundation removed;

DETAILED DESCRIPTION OF THE INVENTION

Figure 2:
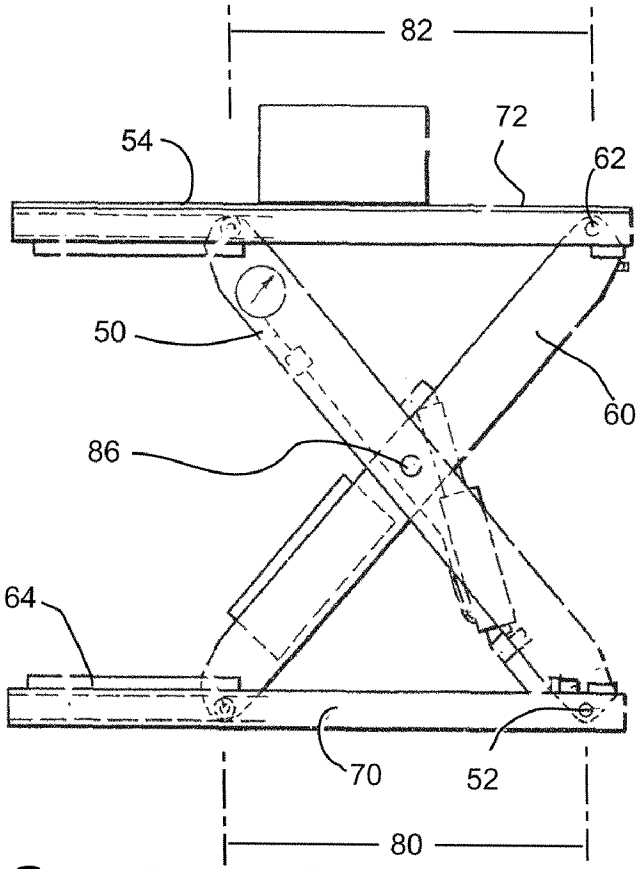
FIG. 2 PRIOR ART
FIG. 2 is a side elevation view of another prior art even link scissor jack.
Figure 1:
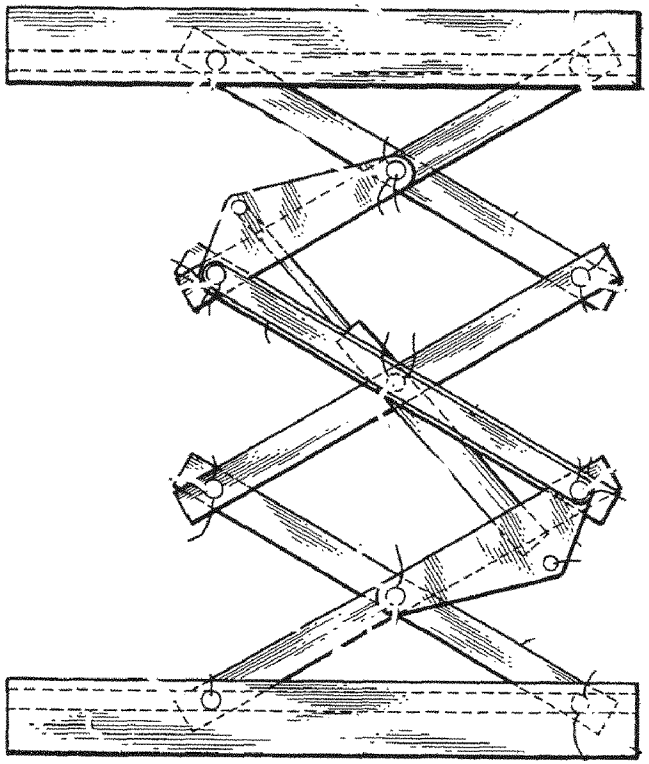
FIG. 1 PRIOR ART
FIG. 1 is a side elevation view of a prior art even link scissor jack.
Figure 3:
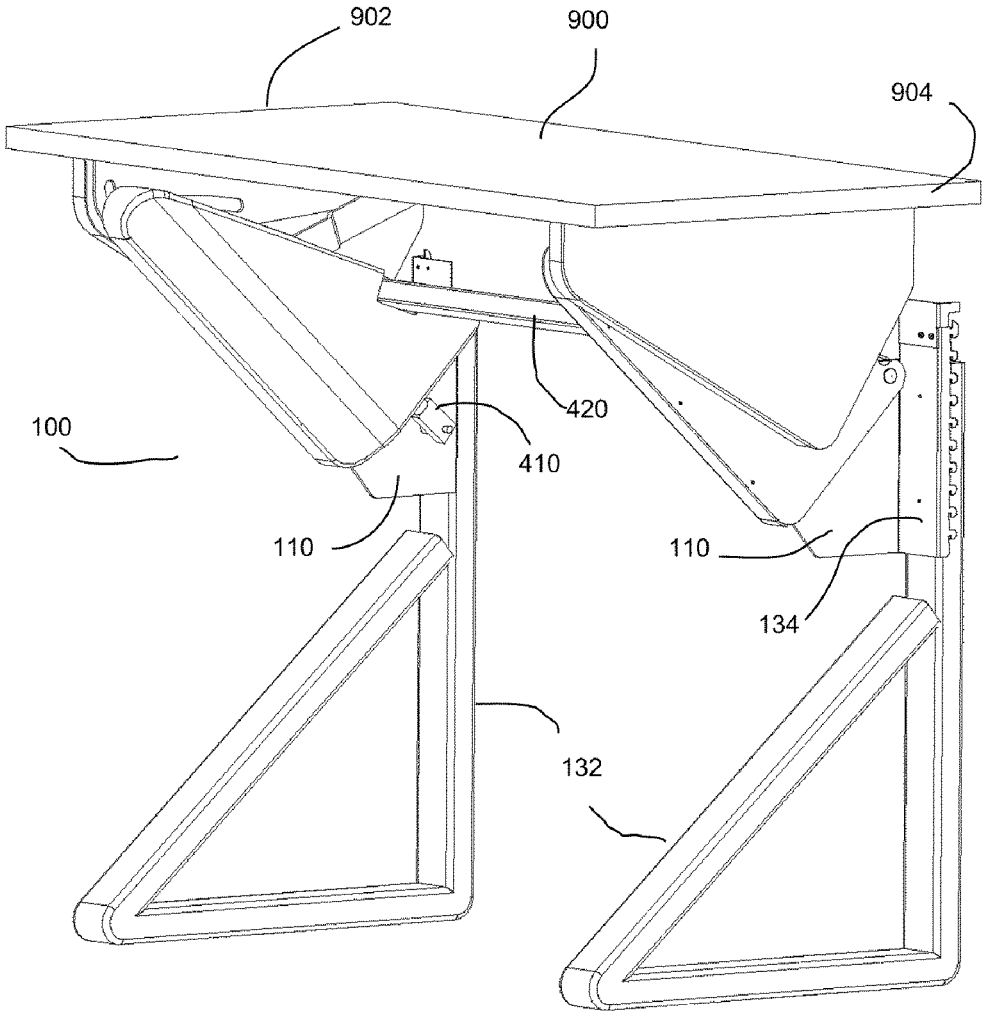
FIG. 3 is an upper front right perspective view of a work surface supported by an odd link work surface lift of the invention, which in turn is supported by legs.
Figure 4:
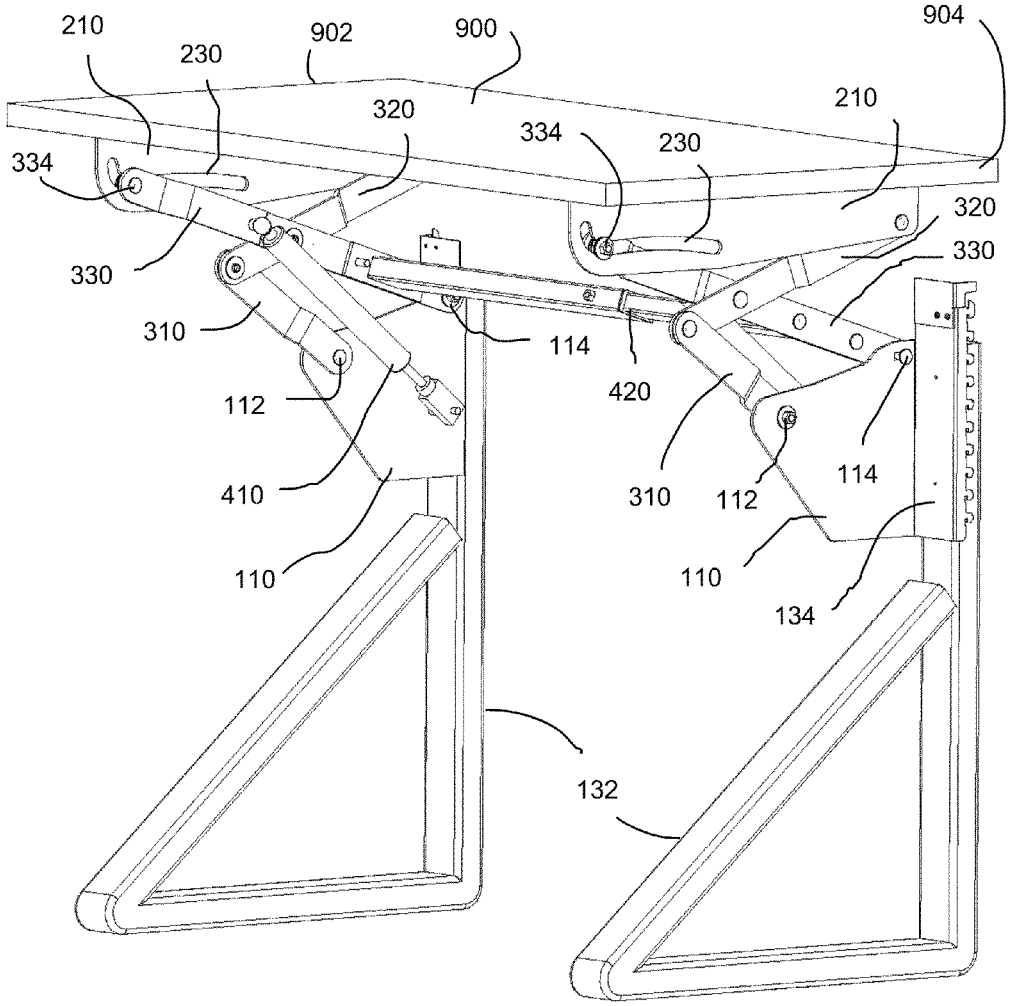
FIG. 4 is the view of FIG. 1 with pinch guards removed showing the odd links.

A preferred embodiment 100 of an odd link work surface lift according to the invention is generally shown in the drawing FIGS. 3-19 and discussed below. As discussed above, prior art even link scissor jack lifts (FIGS. 1 & 2) include a foundation 70 and a table 72 with an even number of links 50, 60 pivotally and slidably interconnected between the foundation and the table. Clearly, then, the present invention is at least distinguishable in that it has a foundation 110, a table 900 supported by a mounting bracket 210, and an odd number of links 300 pivotally and slidably interconnected between the foundation 110 and the bracket 210 (FIG. 4). More preferably, each of the elements of the odd link lift 100 is one of a corresponding pair such that the table 900 is supported above a floor or the like, by a lift near each of two opposite ends 902 & 904 of the table.

Each counterpart of a corresponding pair of elements may be identical (neither left or right handed) or may be minor images of one another (left and right side counterparts). Whether each counterpart of a corresponding pair is identical or a mirror image of its respective counterpart may be immaterial. A pair of identical lifts or of mirror image lifts may be used equally well. One having ordinary skill in the art understands that unique situations may tend to direct a user to prefer a combination of identical lifts, a combination of minor image lifts, or of inverse placement of minor image lifts, for example. One may even employ the lift of the present invention with a sufficiently long table that use of at least three lifts is preferred. Thus, each counterpart of a corresponding pair of elements shall be generally identified here by a common reference number.

The elements of the present invention may be manufactured of any suitable structural or engineering material, including without limitation, wood, metal, and plastic and combinations thereof. Methods of manufacture used may be any that are suitable to the material or materials selected.

More specifically, the foundation 110 may preferably be provided with a front pivot 112 and a back pivot 114. These pivots are generally positioned relatively in front of and behind one another, respectively. They may commonly also be positioned with one of the two pivots higher in elevation relative to the other of the two. Both spacing fore and aft of one another and elevation variation between the two may be dictated according to a particular implementation of the invention as is understood by one having ordinary skill in the art. In the specific implementation shown in the selected preferred embodiment 100, the back pivot is slightly elevated relative to the front pivot, for example. This variation in elevation may facilitate a compact retraction of the lift. Another implementation may indicate a preference for the two pivots to have no or to have another variation in elevation. This variation within the inventive concept is typical of absolute relative location of various elements that are assembled to manufacture the invention and is noted here to identify the relative importance within the inventive concept of general geometry over absolute location. Further instances of such variation within the inventive concept are not noted below and are within the understanding of one having ordinary skill in the art. All that being said, the relative fore and aft location of the front and the back pivots defines a stance 120 of the foundation, which may be appreciated in further discussion below.

The pivots 112 and 114 themselves may also be configured according to a user's desires relative to a particular implementation of the invention. A simple rivet through corresponding apertures may be sufficient in one implementation while a more precise bearing may be desired in another implementation, for example. As with the variation regarding absolute location discussed above, a variation in specific componentry is noted as being within the inventive concept.

Figure 5:
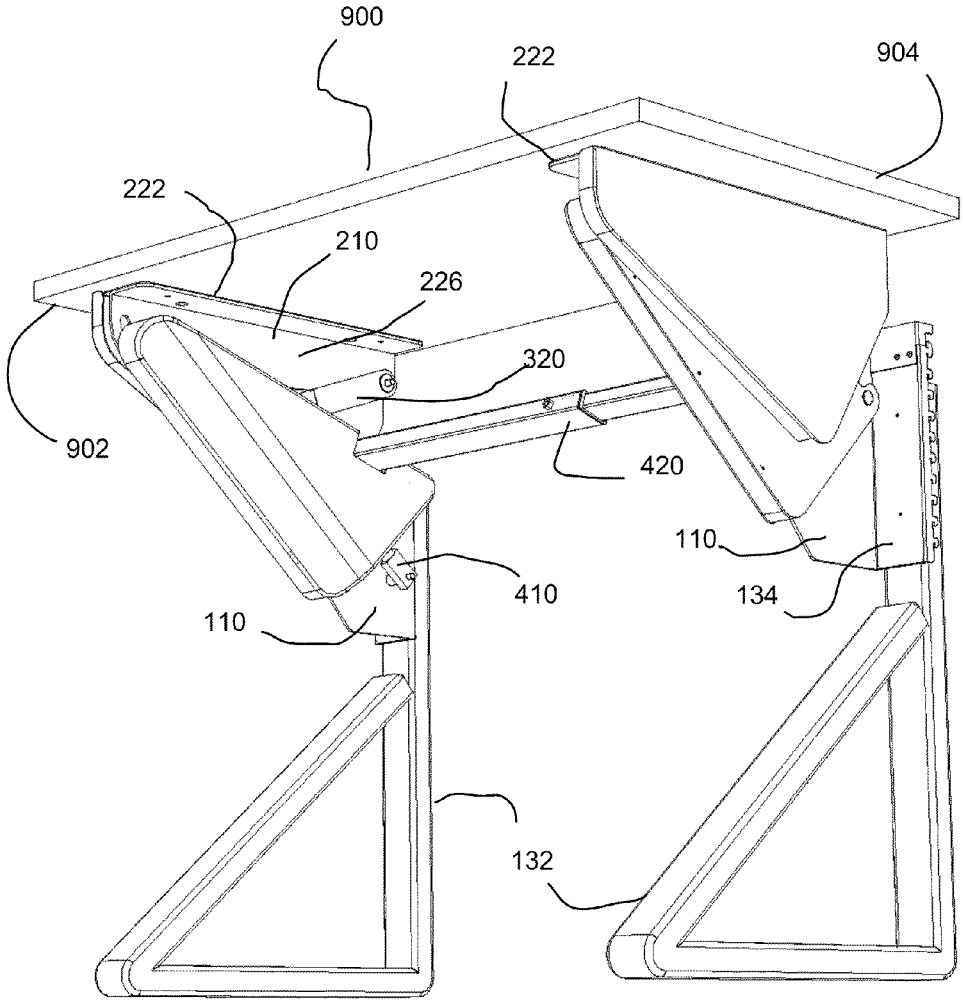
FIG. 5 is a lower front right perspective view of the work surface supported by the odd link lift with pinch guards.
Figure 6:
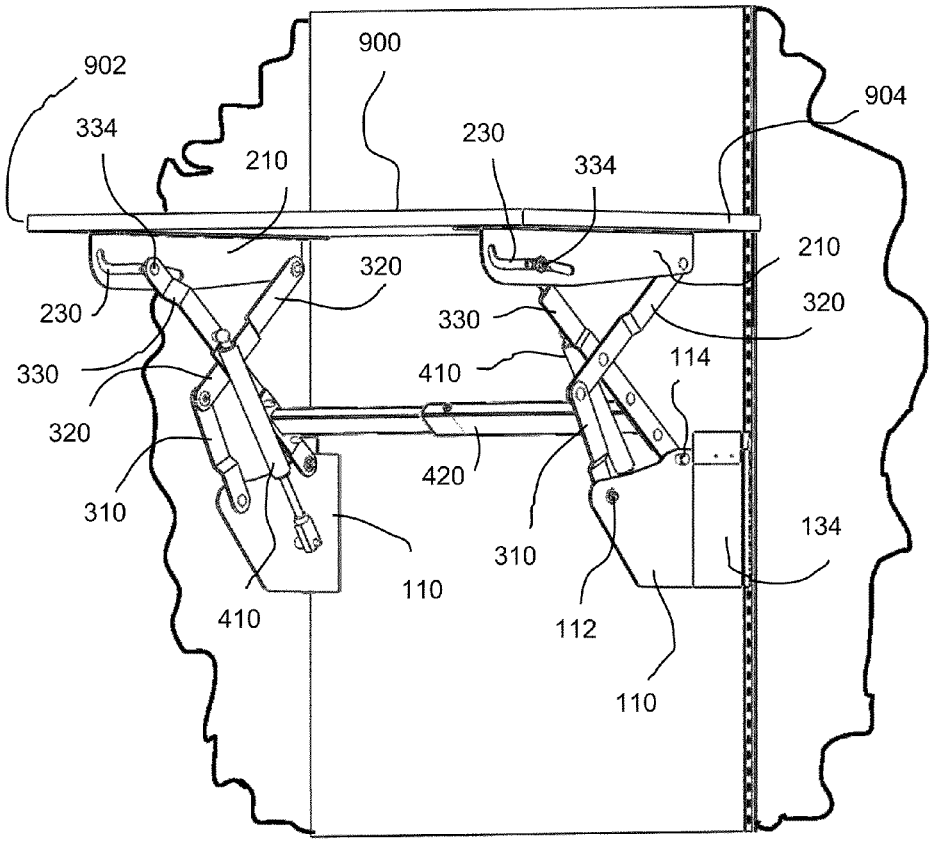
FIG. 6 is a lower front right perspective view of the work surface supported by the odd link lift with pinch guards removed showing the odd links, which in turn is supported by adjustable tracks of a partition panel.
Figure 7:
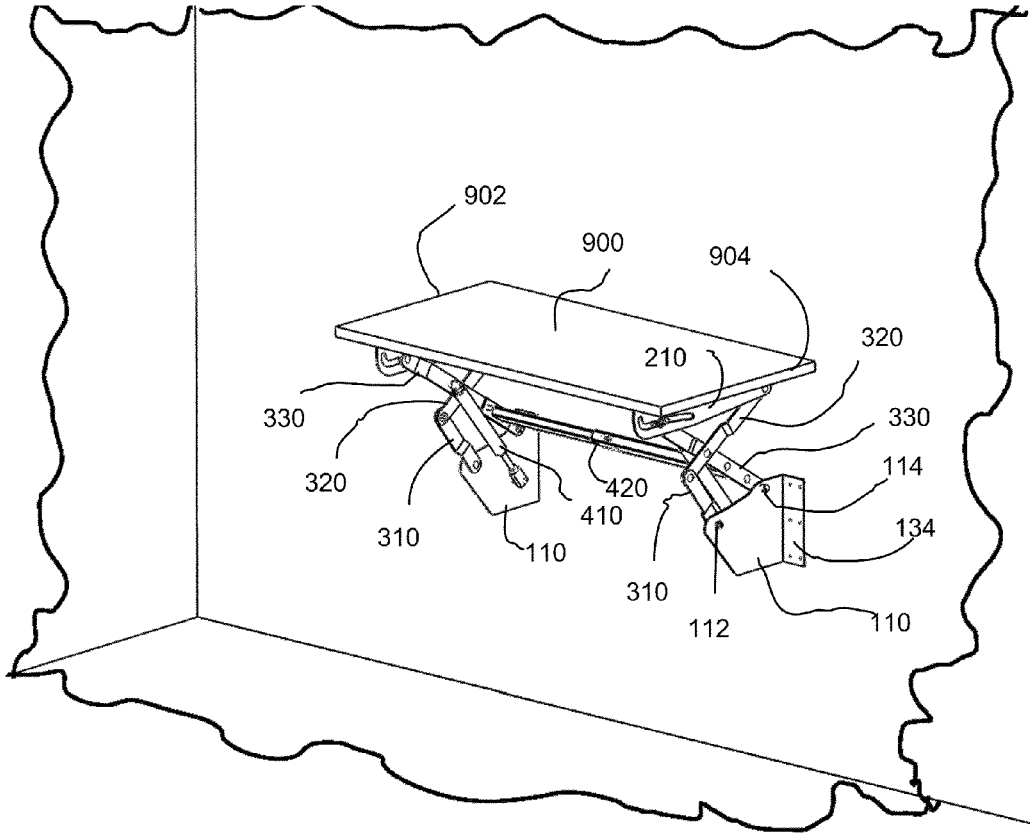
FIG. 7 is an upper front right perspective view of a work surface supported by an odd link work surface lift of the invention with pinch guards removed showing the odd links, which in turn is supported by a wall.
Figure 10:
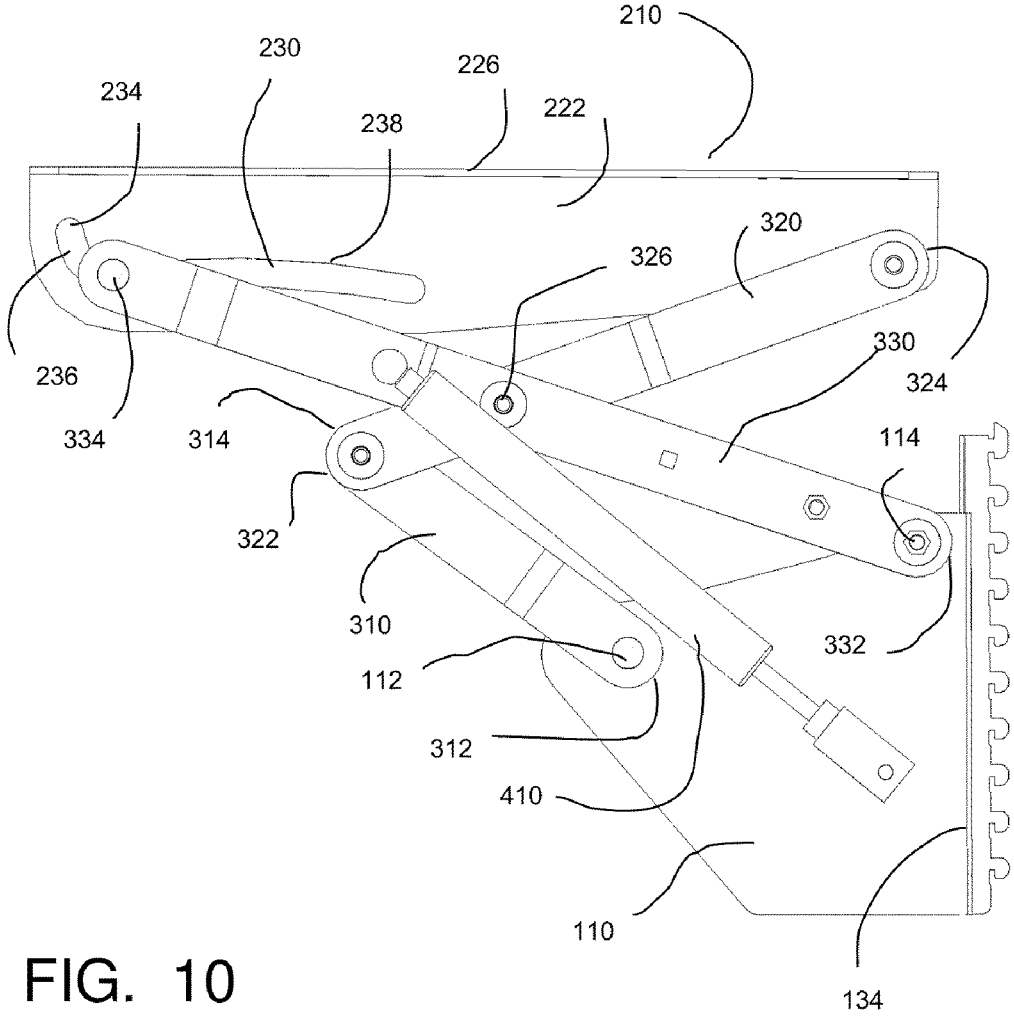
FIG. 10 is a right side elevation view of the left side odd linkage link thereof with left-to-right side connecting bar removed.
Figure 11:
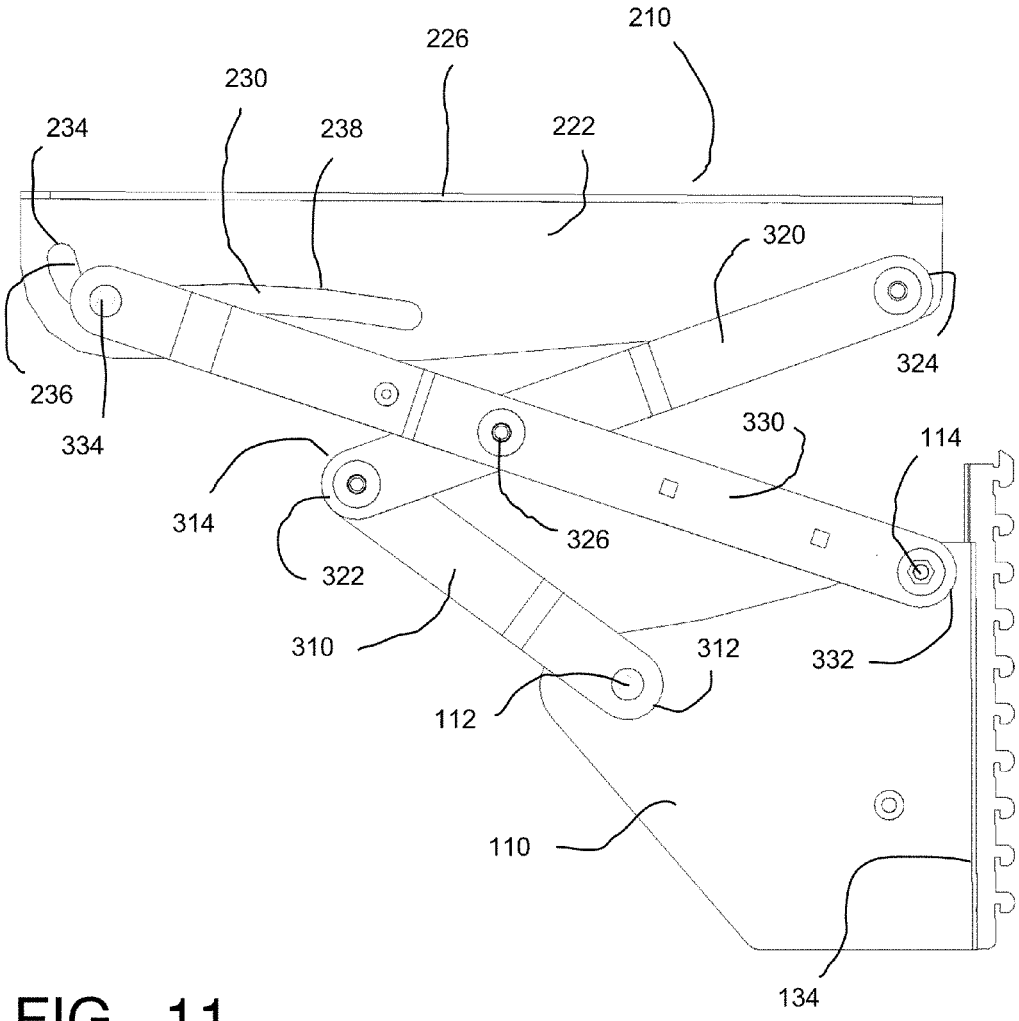
FIG. 11 is the view of FIG. 8 with counterbalance removed.
Figure 12:
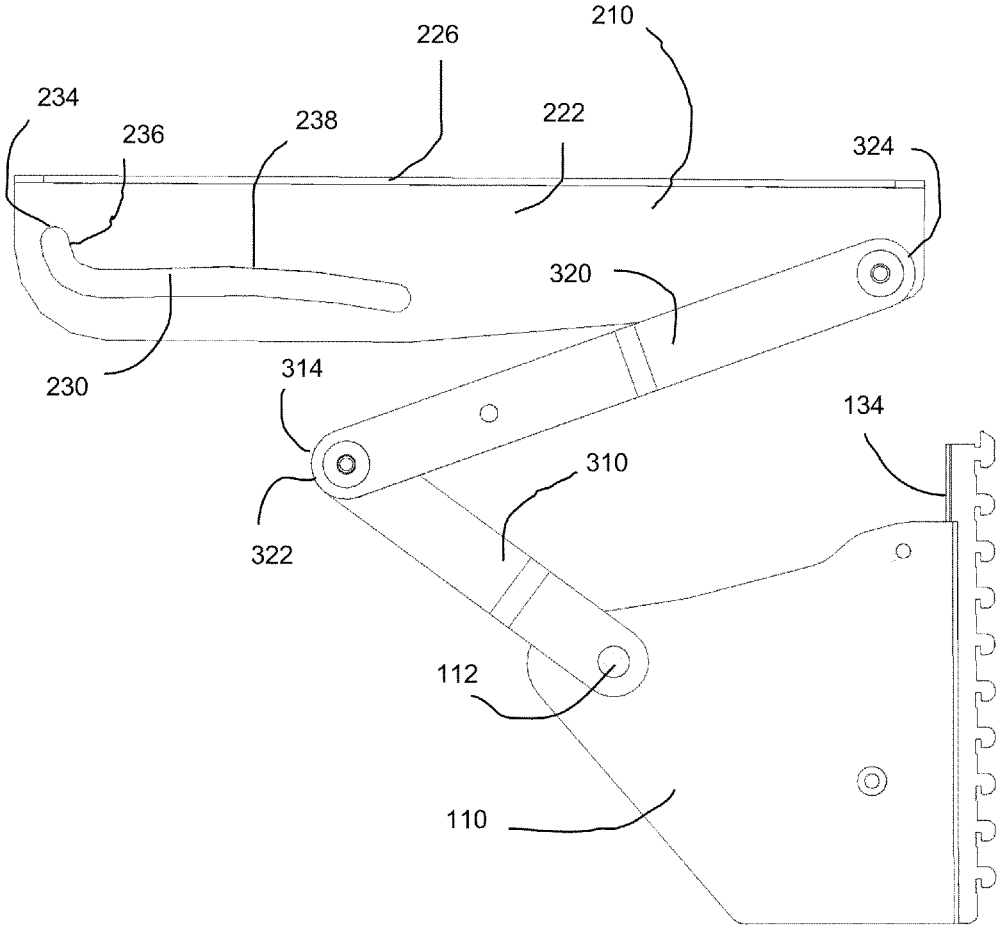
FIG. 12 is the view of FIG. 9 with traveler link removed.

The foundation 110 may include any of various methods and devices by which the foundation is spaced above a floor and the like. A leg 132 may extend generally downward to the floor, for example (FIGS. 3-5). The leg may be substantially permanently incorporated in the foundation or not. The foundation may be provided with a first 134 of two portions of a releasable coupling, while the leg is provided with a second (not shown separately) of the two coupling portions. In one alternative, the first coupling portion 134 may be adapted to releasably couple with various height adjustable tracks 138 and the like as are known to be used with space partition panels and as wall mounted shelf support tracks (FIG. 6). In another implementation, the first coupling portion may be coupled with a cooperating fixed mounting support (not shown separately) that is provided on a wall or other vertical surface and the like and may be further adapted to mount directly on a vertical surface (FIG. 7).

The odd links 300 are generally shown in the drawing figures (FIGS. 3-18) to include a first link 310, a second link 320, and a third or traveler link 330. Each of these three links may substantially be an elongated member with opposing ends. The first link has a first link first end 312 connected with the front pivot 112 and extends generally forward from its first end at the front pivot, away from the back pivot 114, to a first link second end 314.

The second link 320 has a second link first end 322 pivotally connected with the first link second end 314. The second link extends generally backward from its first end at the first link second end, to a second link second end 324. The mounting bracket 210 is pivotally connected with the second link second end.

Figure 13:
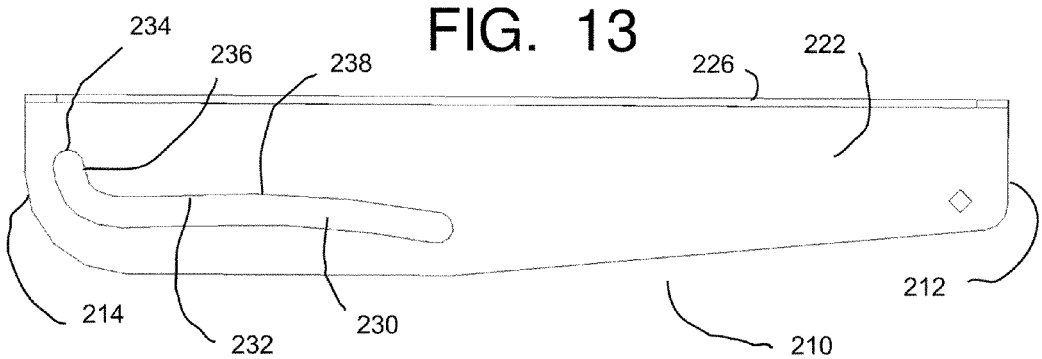
FIG. 13 is the perspective of FIG. 10 showing the right side elevation of the left mounting bracket.
Figure 14:
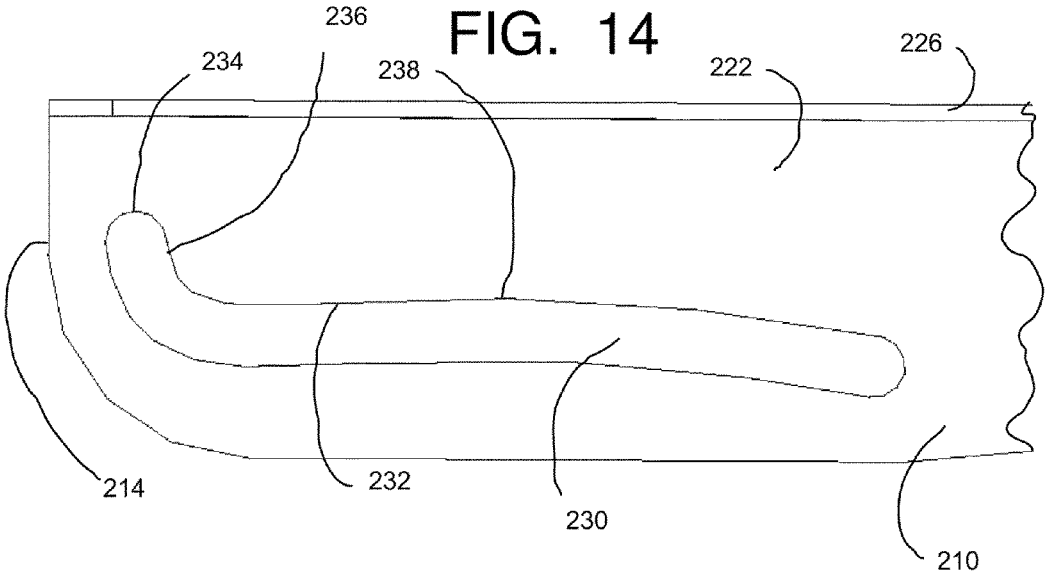
FIG. 14 is an enlarged fragmentary detail thereof showing the L-slot.
Figure 15:
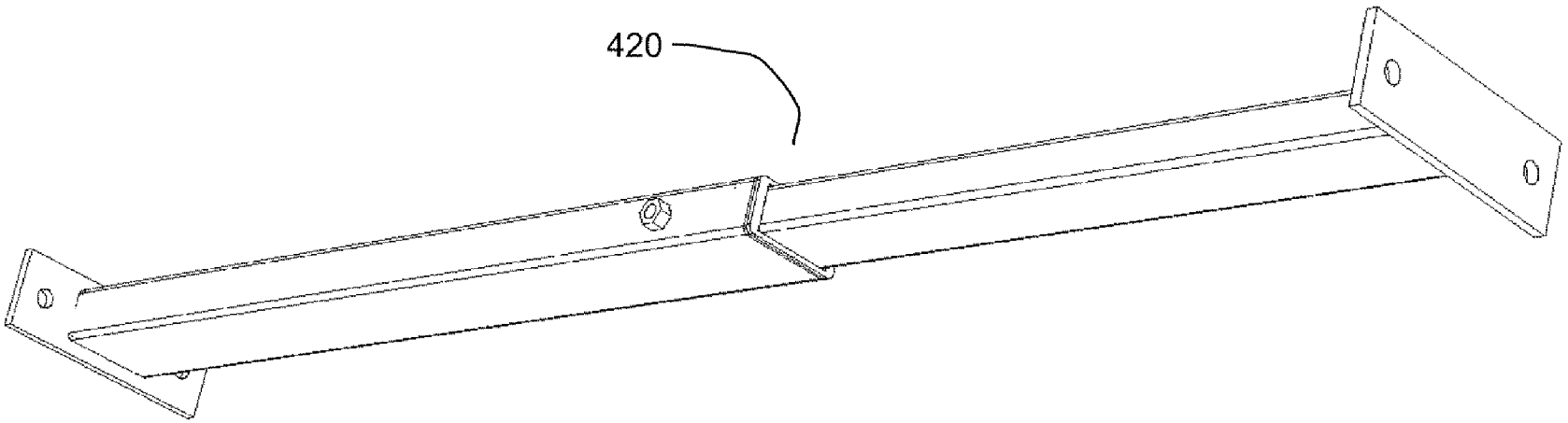
FIG. 15 is an end perspective view of a left-to-right side synchronizer bar.

More specifically, the mounting bracket 210 is an elongated member with opposing ends, namely, a first end 212 and a second end 214 (FIG. 13). The first end 212 is pivotally connected with the second link second end 324 and the mounting bracket extends generally horizontally forward from this pivot connection. The mounting bracket may preferably be provided as a length of angle material having a web portion 222 and a flange portion 226 that extends generally perpendicular to the web from a top edge of the web. The flange may be adapted for mounting of the table 900.

The mounting bracket 210 is also provided with a cam surface 232 that extends generally backward from the bracket second end 214, toward the bracket first end 212. More specifically, a cam stop 234 is defined in the mounting bracket 210 near the front or second end 214. An arcuate cam leg 236 extends generally downward and perhaps somewhat backward from the cam stop. An arcuate cam stem 238 in turn extends generally backward from the cam leg 234.

That being said, a relative fore and aft location of the pivotal connection between the second link 320 and the mounting bracket 210 relative to the cam follower 334 defines a bearing length 220 of the mounting bracket, which may be appreciated in further discussion below.

The cam surface 232 may be an exterior or a portion of a perimeter surface of the mounting bracket 210, or may be defined by a slot 230 defined through the web 222. Either way, the cam surface typically defines a stylized curvilinear L-shaped surface with arcuate stem 234 and arcuate leg 236.

Now, the traveler or third link 330 has a traveler link first end 332 connected with the back pivot 114. The traveler link extends generally forward from its first end at the back pivot, to a traveler link second end 334. A cam follower is provided at the traveler link second end. The cam follower is positioned in abutting engagement with cam surface 232 and is adapted to travel along the cam surface in abutting engagement. The particulars of the cam follower are not absolutely critical to the inventive concept. A particular implementation of the invention may dictate the specifics of the cam follower, including whether the follower is merely a finger member that extends from the traveler link or the follower comprises a rotating sleeve. Thus, one having ordinary skill in the art understands that disclosure of a cam follower is sufficient, that various cam follower mechanisms are included in the present disclosure, and that common use of the reference number 334 for the traveler link second end and for the cam follower is appropriate, no benefit being provided by use of two distinct reference numbers.

The traveler link 330 also crosses over the second link 320 at a midpoint of the traveler link between the traveler link first and second ends, and at a midpoint of the second link between the second link first and second ends. Another pivot, a link pivot 326, pivotally interconnects the traveler and the second links.

Figure 18:
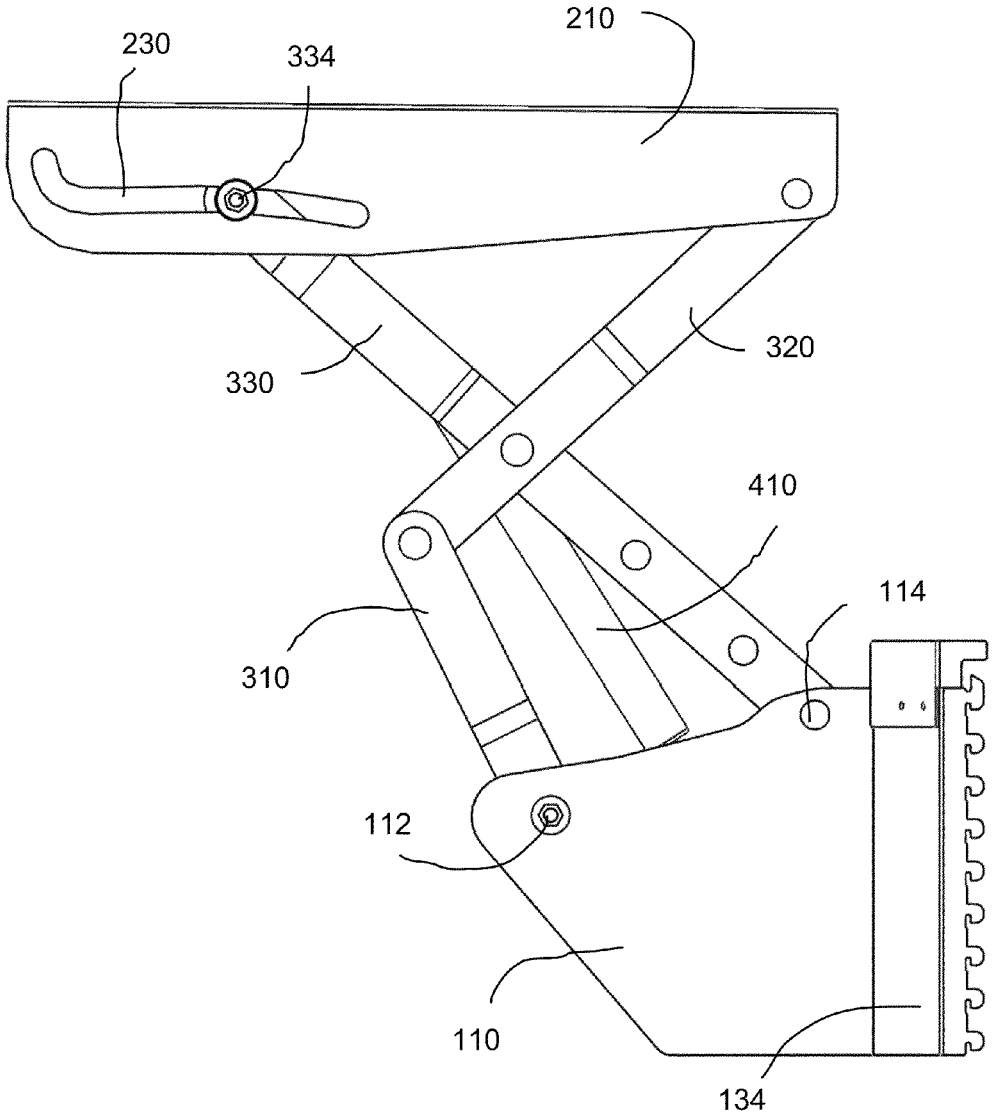
FIG. 18 is the view of FIG. 16 with the lift in a further partially open position.
Figure 19:
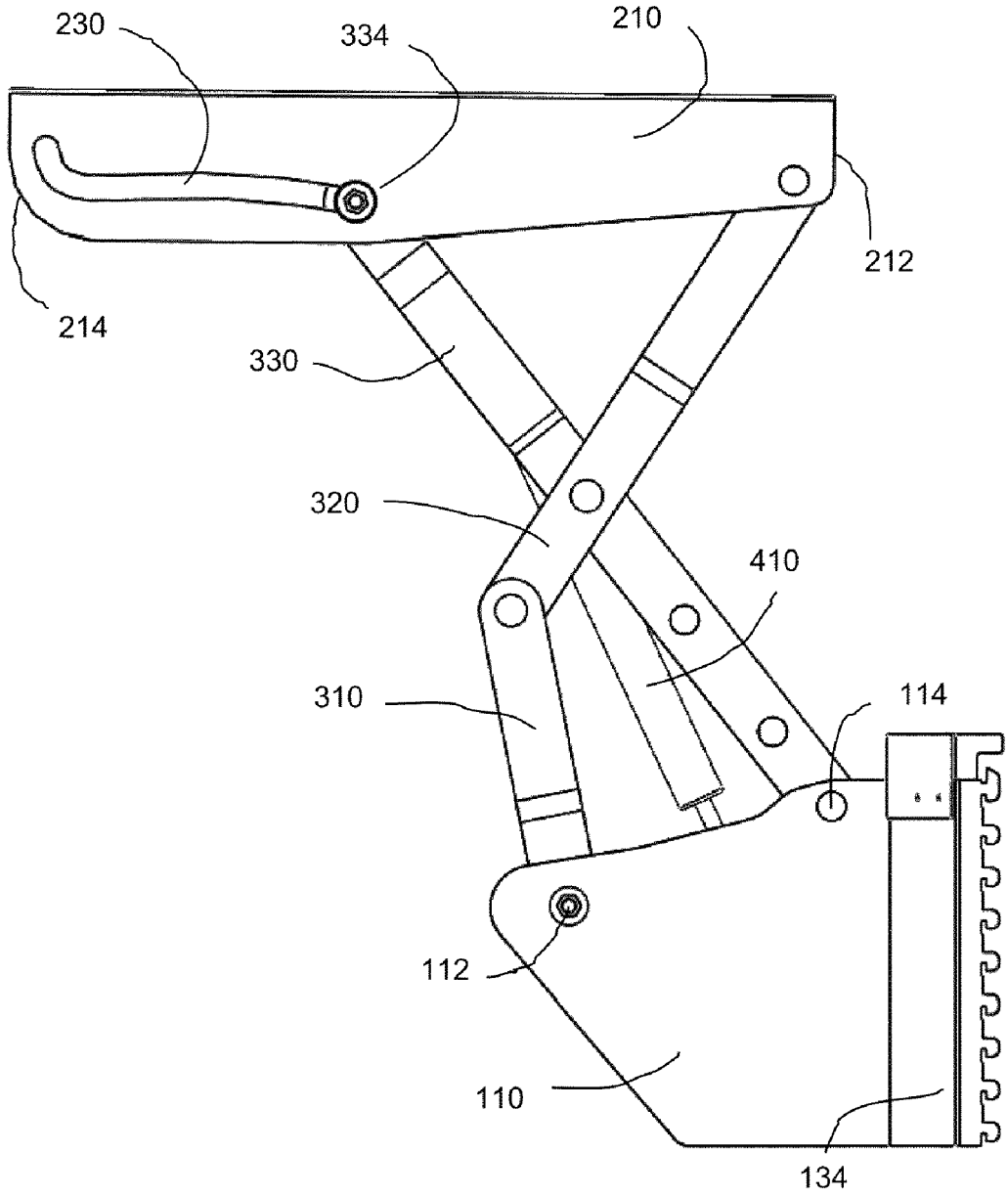
FIG. 19 is the view of FIG. 16 with the lift in an open position.

With various elements described, connected, and discussed above, one may understand operation of the unique odd link work surface lift 100 of the present invention. The lift is extendable from a closed, retracted, or collapsed position (FIG. 16) through intermediate positions (FIGS. 17 & 18) to an open or extended position (FIG. 19). As noted perhaps most clearly in drawing FIG. 16, the bearing length 220 is significantly or materially greater than the stance 120 such that available user space under the table 900 is clear of interference from the foundation or other elements of the lift.

Figure 16:
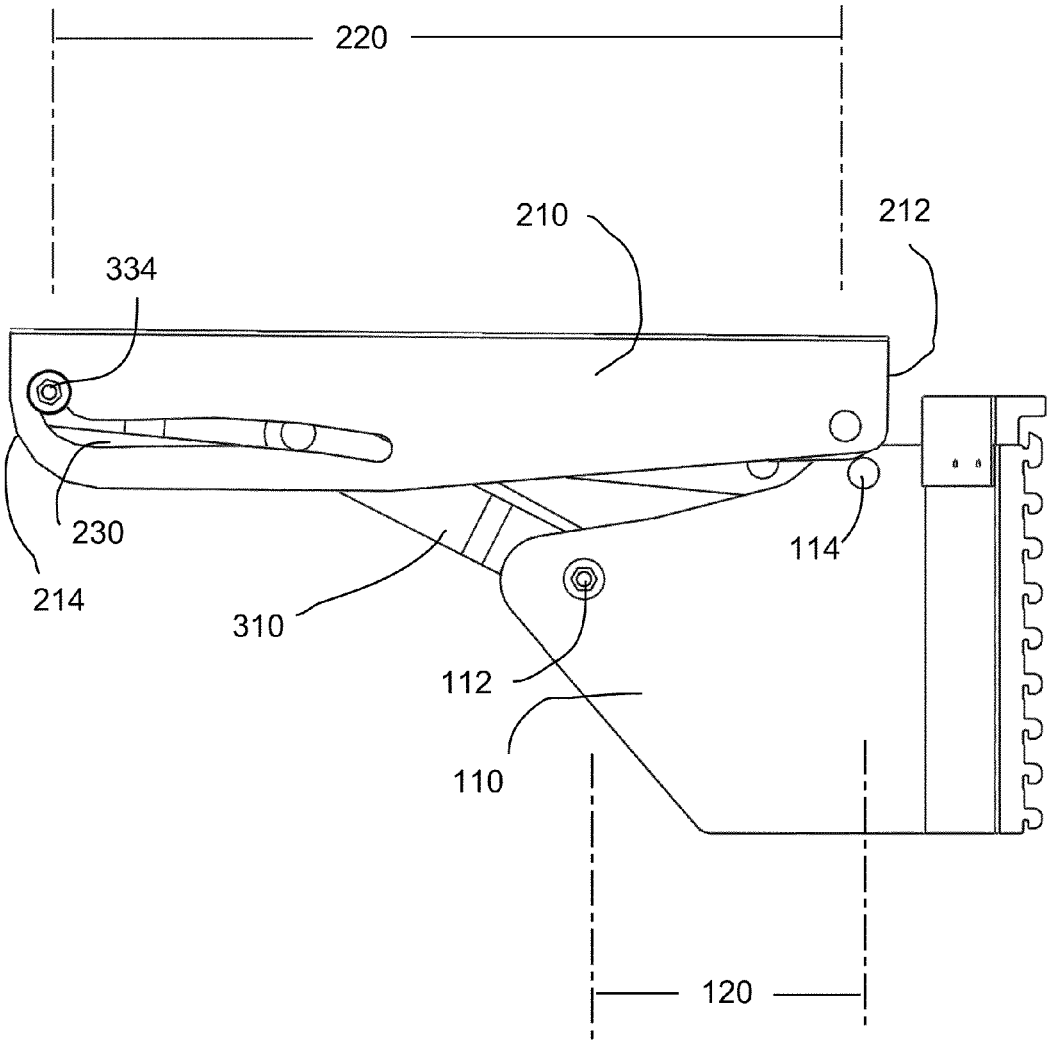
FIG. 16 is a right side elevation view of the odd link lift of FIG. 6 in a closed position with the work surface removed.
Figure 17:
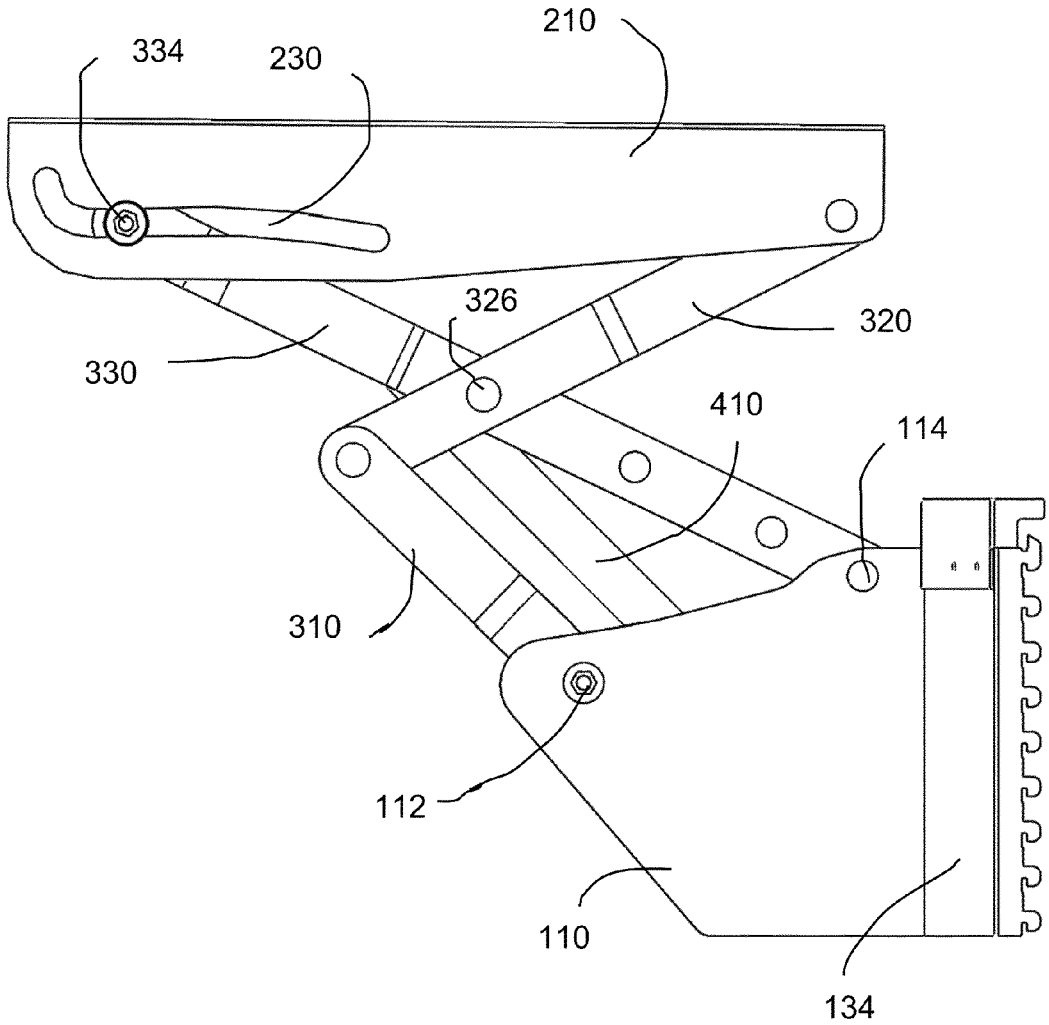
FIG. 17 is the view of FIG. 16 with the lift in a partially open position.

The links 300 may be said to be in a retracted position when the lift 100 is closed (FIG. 16). The cam follower 334 is noted to be lodged in the cam stop 234 when the lift is closed. Extending the lift from its closed position unfolds the links (FIGS. 17-19). Upon extending the lift, the pivotable linkage combination of the first and the second links 310 and 320, respectively, along with the interconnection of the second link with the traveler link 330 by link pivot 326 directs the first or back end 212 of the mounting bracket in a generally vertical path as the lift 100 continues to extend. Concurrently, the cam follower slides downward and backward in abutting engagement along the cam leg 236 of surface 232. This maintains the mounting bracket 210 from rotating as the bracket raises. If the cam surface were linear, rather than curvilinear and more specifically with a stylized L-shape as discussed, the first or back end 212 of the mounting bracket would initially raise quicker than its second or front end 214 as one having ordinary skill in the art understands from the drawing figures (FIGS. 16 & 17).

Of course, the cam follower 334 arcs upward and backward about back pivot 114 when the lift extends away from its closed position. Thus, the cam surface 232 extends generally back from the bracket front 214 so that the cam follower travels back relative to the cam surface and the bracket 210. One having ordinary skill in the art will notice from consideration of the drawing figures that the unique odd link work surface lift of the present invention disclosed herein employs an unique interaction of a compound lever arcing provided by the pivotable linkage combination of the first and the second links 310 and 320, respectively, in coordination with an arcing of the singular traveler link 330 (FIGS. 16-19).

Additional elements to make operation of the lift 100 easier may include a counterbalance 410 to counter gravitational force upon the assembly. The counter balance may be any of various counterbalance mechanisms, including various extendable cylinders, springs, and weights and tackle. A common gas pressurized strut is shown connected between the foundation 110 and the third link 330, for example. The counterbalance may incorporate a locking mechanism such as is known with use of a gas pressurized strut in a height adjustable office chair pedestal and the like. One may alternatively use various lock mechanisms, including ratchet and full extension release ratchet at a pivot, to positively hold the lift at a desired elevation in resistance to a downward vertical force as may frequently be applied by a user leaning on the table 900.

As noted toward the beginning of this section, discussion has been directed to at least a pair of each element. A pair of lift assemblies is generally shown in the drawing figures (FIGS. 3-14). The table has opposite left and right ends, 902 and 904, respectively. One lift assembly is mounted with the table near each of its two ends.

Use of multiple lift assemblies may easily result in wracking between unsynchronized lift assemblies, however. A user may, therefore, find synchronization of multiple lift assemblies to be desirable. A preferred approach to providing a synchronizer 420 is generally shown in the drawing figures (FIGS. 3-15). As shown, a synchronizer may coordinate rotation of corresponding links of the links 300. More specifically as shown, the synchronizer may be provided as a torsion member interconnecting the third links 330, for example. Although the pair of first links 310 or the pair of second links 320 may also or alternatively be tied together rotationally. Further, provision of the synchronization task may include a torsion bar that interconnects a pair of corresponding links and may further be incorporated as a pivot in corresponding pivot connections.

One having ordinary skill in the art and those who practice the invention will understand from this disclosure that various modifications and improvements may be made without departing from the spirit of the disclosed inventive concept. One will also understand that various relational terms, including left, right, front, back, upward, and downward, for example, may be used in this detailed description of the invention and in the claims only to convey relative positioning of various elements of the claimed invention without limitation to the invention.

What is claimed is:

1. An odd link work surface lift that is adapted to extend from a closed position to an open position, thus elevating a connected work surface and to retract from the open position to the closed position, thus lowering the work surface, comprising:

a foundation, the foundation having a front pivot and having a back pivot that is spaced from the front pivot, the foundation further having a stance that is defined as a distance of the spacing of the front and the back pivots;

a first link, the first link being an elongated member with opposing first and second ends, the first end being pivotally connected with the front pivot;

a second link, the second link being an elongated member with opposing first and second ends, the first end being pivotally connected with the first link second end, the second link further having a link pivot between its first and second ends;

a mounting bracket, the mounting bracket being an elongated member with opposing first and second ends, the first end being pivotally connected with the second link second end, the mounting bracket further having a cam surface extending from a cam stop at the second end toward the first end; and a traveler link, the traveler link being an elongated member with opposing first and second ends, the first end being pivotally connected with the back pivot, the traveler link extending from the foundation to the mounting bracket cam surface, the traveler link further including a cam follower at its second end, the cam follower being positioned in abutting engagement with the cam surface and being adapted to travel along the cam surface in abutting engagement, the link pivot being connected with the traveler link between the first and second ends;

the mounting bracket further including a bearing length that is defined as a distance between the cam follower and the pivot connection of the mounting bracket first end with the second link second end.

2. The lift defined in claim 1, wherein the cam surface is a stylized curvilinear L-shaped surface with an arcuate stem and an arcuate leg.

3. The lift defined in claim 2, wherein the stem extends generally horizontally from the mounting bracket front end toward the back end and the leg extends generally vertically upward at the mounting bracket front end from the stem.

4. The lift defined in claim 2, wherein the foundation further includes a foundation bracket and a leg that extends generally downward from the foundation bracket, the leg being adapted to support the foundation bracket and the lift above a supporting floor surface.

5. The lift defined in claim 2, wherein the foundation further includes one portion of a releasable hanging coupling, the one portion being adapted to couple with a cooperating second portion in releasable engagement, the cooperating second portion being one of a group including a partition panel adjustable hanging track, a wall mountable adjustable hanging track, and a wall mountable fixed mounting bracket.

6. The lift defined in claim 2, wherein the mounting bracket further includes a web and a flange, the web being a generally vertically oriented plate portion with a top edge, the cam surface being defined in the web, the flange being a plate portion that extends generally horizontally from the tip edge and being adapted to support a work surface.

7. The lift defined in claim 2, further including a counterbalance, the counterbalance extending between the foundation and one of the traveler link and the second link, the counterbalance being an extensible member that assists in opening the lift from the closed position in which the mounting bracket is relatively near the foundation and the counterbalance is in a retracted position, to the open position in which the mounting bracket is relatively apart from the foundation and the counterbalance is in an extended position.

8. The lift defined in claim 7, wherein the stem extends generally horizontally from the mounting bracket front end toward the back end and the leg extends generally vertically upward at the mounting bracket front end from the stem.

9. The lift defined in claim 1, wherein the bearing length is materially greater than the stance.

10. The lift defined in claim 1, wherein the lift is a first lift assembly and the invention further comprises:

a work surface, the work surface being a generally planar member with a length defined between two opposing ends, a width defined between two opposing sides, and a thickness defined between two opposing faces; and a second lift assembly, the second lift assembly being fastened with the work surface near a second one of the ends and the first lift being fastened with the work surface near a first one of the ends.

11. The lift defined in claim 10, further including a synchronizer that interconnects the first and the second lift assemblies such that the first and the second lifts extend uniformly from their respective closed positions and retract uniformly from their respective open positions.

12. The lift defined in claim 10, wherein the cam surface is a stylized curvilinear L-shaped surface with an arcuate stem extending generally horizontally from the mounting bracket front end toward the back end, and an arcuate leg extending generally vertically upward at the mounting bracket front end from the stem.

13. The lift defined in claim 11, wherein at least one of the first lift assembly and the second lift assembly further includes a counterbalance, the counterbalance extending between the respective foundation and one of the respective traveler link and the respective second link, the counterbalance being an extensible member that assists in opening the lift from a closed position in which the mounting brackets are relatively near their respective foundation and the counterbalance is in a retracted position, to an open position in which the mounting brackets are relatively apart from their respective foundation and the counterbalance is in an extended position.

14. The lift defined in claim 10, wherein the bearing length of each mounting bracket is materially greater than the stance of the respective foundation.

15. An odd link work surface lift that is adapted to extend from a closed position to an open position, thus elevating a connected work surface and to retract from the open position to the closed position, thus lowering the work surface, comprising:

a foundation, the foundation having a front and an opposing back;

a front pivot near the foundation front;

a back pivot near the foundation back;

a stance that is defined as a distance between the front and the back pivots;

a first link, the first link being an elongated member with opposing first and second ends, the first end being pivotally connected with the front pivot;

a second link, the second link being an elongated member with opposing first and second ends, the first end being pivotally connected with the first link second end, the second link further having a link pivot between its first and second ends;

a mounting bracket, the mounting bracket being an elongated member with opposing first and second ends, the first end being pivotally connected with the second link second end, the mounting bracket further having a cam stop at the second end and having a curvilinear cam surface with an arcuate leg extending generally vertically downward at the mounting bracket second end from the cam stop and with an arcuate stem extending generally horizontally from the leg toward the first end; and a traveler link, the traveler link being an elongated member with opposing first and second ends, the first end being pivotally connected with the back pivot, the traveler link extending from the foundation to the mounting bracket cam surface, the traveler link further including a cam follower at its second end, the cam follower being positioned in abutting engagement with the cam surface and traveling along the cam surface in abutting engagement, the link pivot being connected with the traveler link between the traveler link first and second ends;

the mounting bracket further having a bearing length that is defined as a distance between the cam follower and the pivot connection of the mounting bracket first end with the second link second end.

16. The lift defined in claim 15, wherein the foundation further includes one of two portions of a coupling that is adapted to couple with a cooperating second of the two portions in releasable engagement, the cooperating second portion being one of a group including a partition panel adjustable hanging track, a wall mountable adjustable hanging track, a wall mountable fixed mounting bracket, and a floor standing leg that is adapted to support the foundation bracket and the lift above a supporting floor surface.

17. The lift defined in claim 16, further including a counterbalance, the counterbalance extending between the foundation and one of the traveler link and the second link, the counterbalance being an extensible member that assists in opening the lift from the closed position in which the mounting bracket is relatively near the foundation and the counterbalance is in a retracted position, to the open position in which the mounting bracket is relatively apart from the foundation and the counterbalance is in an extended position.

18. The lift defined in claim 17, wherein the bearing length is materially greater than the stance.

19. The lift defined in claim 15, further including a counterbalance, the counterbalance extending between the foundation and one of the traveler link and the second link, the counterbalance being an extensible member that assists in opening the lift from the closed position in which the mounting bracket is relatively near the foundation and the counterbalance is in a retracted position, to the open position in which the mounting bracket is relatively apart from the foundation and the counterbalance is in an extended position.

20. The lift defined in claim 15, wherein the bearing length is materially greater than the stance.

21. The lift defined in claim 15, wherein the lift is a first lift assembly and the invention further comprises:

a work surface, the work surface being a generally planar member with a length defined between two opposing ends, a width defined between two opposing sides, and a thickness defined between two opposing faces of two lifts; and a second lift assembly, the second lift assembly being fastened with the work surface near a first one of the ends and the first lift being fastened with the work surface near a second one of the ends.

22. The lift defined in claim 21, further including a synchronizer that interconnects the first and the second lift assemblies such that the first and the second lifts extend uniformly from their respective closed positions and retract uniformly from their respective open positions.

23. The lift defined in claim 22, wherein at least one of the first lift assembly and the second lift assembly further includes a counterbalance, the counterbalance extending between the respective foundation and one of the respective traveler link and the respective second link, the counterbalance being an extensible member that assists in opening the lift from a closed position in which the mounting brackets are relatively near their respective foundation and the counterbalance is in a retracted position, to an open position in which the mounting brackets are relatively apart from their respective foundation and the counterbalance is in an extended position.

24. The lift defined in claim 21, wherein the bearing length of each mounting bracket is materially greater than the stance of the respective foundation.

25. In a scissor jack work surface lift having a foundation with front and back pivots, having a stance that is defined as a distance between the front and the back pivots, having a first link pivotally connected with the front pivot and extending to a first terminal end, having a second link pivotally connected with the first terminal end and extending to a second terminal end, and having a mounting bracket with opposing front and back ends, the second terminal end being pivotally connected with the mounting bracket back end, the improvement of an odd link, comprising:

a traveler link pivotally connected with the back pivot and extending to a traveler terminal end;

a curvilinear cam surface defined in the mounting bracket, the cam surface extending from the front end toward the back end; and a cam follower defined at the traveler terminal end, the cam follower abutting the cam surface.

26. The lift defined in claim 25, wherein the cam surface is a stylized curvilinear L-shaped surface with an arcuate stem and an arcuate leg.

27. The lift defined in claim 26, wherein the stem extends generally horizontally from the mounting bracket front end toward the back end and the leg extends generally vertically upward at the mounting bracket front end from the stem to a cam stop.

28. The lift defined in claim 27, wherein the foundation further includes one of two portions of a coupling that is adapted to couple with a cooperating second of the two portions in releasable engagement, the cooperating second portion being one of a group including a partition panel adjustable hanging track, a wall mountable adjustable hanging track, a wall mountable fixed mounting bracket, and a floor standing leg that is adapted to support the foundation bracket and the lift above a supporting floor surface.

29. The lift defined in claim 27, further including a counterbalance, the counterbalance extending between the foundation and one of the traveler link and the second link, the counterbalance being an extensible member that assists in opening the lift from the closed position in which the mounting bracket is relatively near the foundation and the counterbalance is in a retracted position, to the open position in which the mounting bracket is relatively apart from the foundation and the counterbalance is in an extended position.

30. The lift defined in claim 29, wherein the mounting bracket further has a bearing length that is defined as a distance from the pivot connection of the mounting bracket first end with the second link second end to the cam stop and wherein the bearing length is materially greater than the stance.

31. The lift defined in claim 25, wherein the lift is a first lift assembly and the invention further comprises:

a work surface, the work surface being a generally planar member with a length defined between two opposing ends, a width defined between two opposing sides, and a thickness defined between two opposing faces of two lifts; and a second lift assembly, the second lift assembly being fastened with the work surface near a second one of the ends and the first lift being fastened with the work surface near a first one of the ends.

32. The lift defined in claim 31, further including a synchronizer that interconnects the first and the second lift assemblies such that the first and the second lifts extend uniformly from their respective closed positions and retract uniformly from their respective open positions.

33. The lift defined in claim 32, wherein the cam surface is a stylized curvilinear L-shaped surface with an arcuate stem extending generally horizontally from the mounting bracket front end toward the back end, and an arcuate leg extending generally vertically upward at the mounting bracket front end from the stem to a cam stop.

34. The lift defined in claim 32, wherein at least one of the first lift assembly and the second lift assembly further includes a counterbalance, the counterbalance extending between the respective foundation and one of the respective traveler link and the respective second link, the counterbalance being an extensible member that assists in opening the lift from a closed position in which the mounting brackets are relatively near their respective foundation and the counterbalance is in a retracted position, to an open position in which the mounting brackets are relatively apart from their respective foundation and the counterbalance is in an extended position.

35. The lift defined in claim 31, wherein the mounting bracket further has a bearing length that is defined as a distance between the cam follower and the pivot connection of the mounting bracket first end with the second link second end and wherein the bearing length of each mounting bracket is materially greater than the stance of the respective foundation.

* * * * *